US007435187B2

(12) United States Patent
Stites et al.

(10) Patent No.: US 7,435,187 B2
(45) Date of Patent: Oct. 14, 2008

(54) GOLF CLUB INCORPORATING A DAMPING ELEMENT

(75) Inventors: John Thomas Stites, Weatherford, TX (US); Gary Gene Tavares, Azle, TX (US)

(73) Assignee: Nike, Inc., Beaverton, OR (US)

( * ) Notice: Subject to any disclaimer, the term of this patent is extended or adjusted under 35 U.S.C. 154(b) by 658 days.

(21) Appl. No.: 10/739,285

(22) Filed: Dec. 19, 2003

(65) Prior Publication Data

US 2005/0137026 A1 Jun. 23, 2005

(51) Int. Cl.
*A63B 53/00* (2006.01)

(52) U.S. Cl. ..... 473/318

(58) Field of Classification Search ..... 473/318
See application file for complete search history.

(56) References Cited

U.S. PATENT DOCUMENTS

| | | | | |
|---|---|---|---|---|
| 5,183,264 | A | 2/1993 | Lanctot | |
| 5,308,062 | A * | 5/1994 | Hogan | 473/292 |
| 5,316,300 | A | 5/1994 | Simmons | |
| 5,718,643 | A | 2/1998 | Wright et al. | |
| 5,779,968 | A * | 7/1998 | Richwine et al. | 264/515 |
| 5,904,628 | A * | 5/1999 | MacKay et al. | 473/326 |
| 5,944,616 | A * | 8/1999 | Horwood et al. | 473/289 |
| 6,015,525 | A * | 1/2000 | Patitsas et al. | 264/315 |
| 6,053,827 | A * | 4/2000 | MacKay et al. | 473/566 |
| 6,402,879 | B1 * | 6/2002 | Tawney et al. | 156/292 |
| 2001/0023210 | A1 | 9/2001 | Munster | |
| 2003/0022729 | A1 | 1/2003 | Pergande et al. | |

FOREIGN PATENT DOCUMENTS

| | | |
|---|---|---|
| CA | 2229920 | 2/1998 |
| GB | 2 247 932 A | 3/1992 |
| JP | 02-243173 | 9/1990 |

OTHER PUBLICATIONS

The RandomHouse College Dictionary, Revised Edition, 1975, p. 1453 definition of valve.*

(PCT) International Search Report from International Application No. PCT/US2004/039768, filed Dec. 15, 2004, 9 pages.

* cited by examiner

*Primary Examiner*—Stephen L. Blau
(74) *Attorney, Agent, or Firm*—Banner + Witcoff, Ltd.

(57) ABSTRACT

A damping element for a golf club is disclosed. The damping element is utilized to reduce an amplitude of vibrations in the golf club. The damping element may be positioned within an interior void of a shaft of the golf club and may exhibit a shape that corresponds with a shape of the void within the shaft. The damping element may exhibit an elongate configuration that extends along at least a portion of the shaft, and the damping element may have the configuration of either a fluid-filled chamber or a foam structure.

6 Claims, 14 Drawing Sheets

GOLF CLUB INCORPORATING A DAMPING ELEMENT

BACKGROUND OF THE INVENTION

1. Field of the Invention

The present invention relates to equipment for the sport of golf. The invention concerns, more particularly, a golf club having a shaft that encloses a damping element, such as a fluid-filled chamber or a polymer foam member, for example.

2. Description of Background Art

The formal origins of the game of golf, one of the oldest international sports, dates to the $16^{th}$ century at The Royal and Ancient Golf Club at St. Andrews, located in Scotland. During successive centuries, the game of golf has gained and maintained a populous following due to inherent challenges of the game, a respected reputation, and its suitability for relaxation. Due to an increasing growth in the number of individuals playing the game of golf, manufacturers of golf equipment, which includes golf clubs, balls, and footwear, regularly modify and improve upon the various features and characteristics of the golf equipment. Golf equipment has, therefore, evolved over time to provide enhanced performance and suitability for a wide range of playing abilities and styles, with many of the advances relating to the configuration and materials that are utilized in the golf equipment.

Advancements in golf technology also apply to golf clubs, which are utilized to propel a golf ball toward an intended target. The primary elements of a golf club are a head that is secured to an end of a shaft. Although some traditional golf club heads were formed from wood or combinations of wood and steel, a modern head is primarily formed from one or more metals, such as steel, aluminum, or titanium. Similarly, traditional golf club shafts were often fashioned from wood, whereas a modern shaft is commonly formed from either metal or graphite materials.

During the game of golf, an individual grasps the shaft and swings the golf club such that the head traverses a generally arcuate path and impacts a golf ball. A portion of the inertia of the golf club, and particularly the inertia of the head, is then transferred to the golf ball and propels the golf ball toward the intended target. One factor that influences the trajectory of the golf ball following impact is the configuration of the shaft and materials that are utilized in the shaft. Although a golf club shaft may have a hollow, cylindrical configuration with a constant thickness throughout the length of the shaft, many modern shafts exhibit a tapered or stepped configuration. That is, the diameter of the shaft decreases from the area where the individual grasps the shaft to the area where the head is secured to the shaft. The configuration of the shaft and the material selected for the shaft have an effect upon the performance characteristics of the shaft, which include the degree of flex in the shaft, the position of the kick point, and the torque necessary to twist the shaft, for example.

Depending upon the specific shaft configuration, vibrations may arise in the shaft following impact with the golf ball or the ground. Although absorbing a portion of the vibrational forces does not generally pose concerns, repeatedly absorbing a portion of the vibrational forces may affect the hands or the joints of the individual. In general, the configuration of the shaft (e.g., thickness, material, degree of tapering, etc.) may be modified to lessen the amplitude or adjust the frequency of the shaft, but such modifications may have an adverse effect upon the performance characteristics of the shaft.

SUMMARY OF THE INVENTION

The present invention is a damping element for a golf club that reduces an amplitude of vibrations in the golf club, and particularly a shaft of the golf club. The damping element is positioned within an interior void of the shaft and may exhibit a shape that corresponds with a shape of the void within the shaft. Although the damping element may have a variety of configurations with in the scope of the present invention, the damping element may exhibit an elongate configuration that extends along at least a portion of the shaft. Furthermore, the damping element may have the configuration of either a fluid-filled chamber or a foam structure.

When formed to be a fluid-filled chamber, the damping element may have a sealed outer barrier formed of a polymer material that is substantially impermeable to the fluid. In some embodiments of the invention the polymer material is a thermoplastic elastomer, and the fluid is a gas. Similarly, the damping element may include a polymer foam, such as ethylvinylacetate or polyurethane, when formed to be a foam structure. A variety of shapes are suitable for the damping element. For example, the damping element may have a cylindrical configuration, a tapered configuration, or a stepped configuration. In embodiments where the damping element is a fluid-filled chamber, opposite sides of the chamber may be bonded to each other.

The damping element is utilized to reduce the amplitude of vibrations in the shaft. Accordingly, one aspect of the invention relates to a method of modifying vibrational characteristics of a golf club that includes selecting a shape for the damping element, selecting a position for the damping element with respect to the shaft, and locating the damping element within the shaft. Another aspect of the invention is a method of manufacturing a golf club that includes forming a shaft to defines a void within an interior portion of the shaft, locating a damping element within the void, and securing a head to an end of the shaft.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose a golf club 10 and a golf club 10' that incorporate damping elements in accordance with the present invention.

Whereas golf club 10 has the configuration of a driver, golf club 10' has the configuration of an iron. Golf club 10 and golf club 10' are intended to provide examples of the various types of golf clubs that may incorporate a damping element. Other types of golf clubs, however, that are not specifically depicted in the figures or discussed in the following material, such as a putter or a fairway wood, may also incorporate a damping element within the scope of the present invention. Concepts related to the present invention apply, therefore, to a variety of golf club styles.

Figure 1:
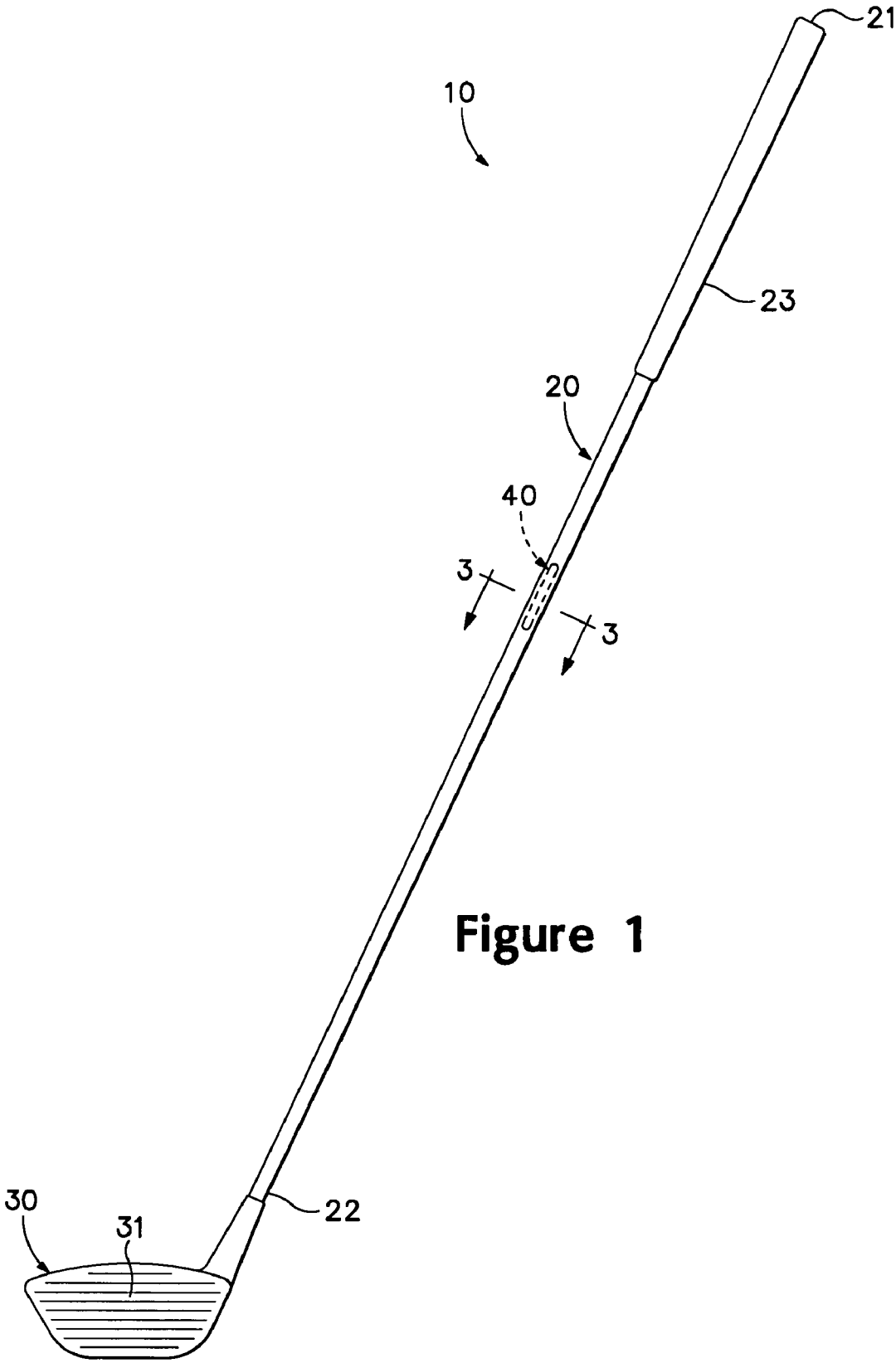
FIG. 1 is an elevational view of a golf club having a shaft with a damping element in accordance with the present invention.

Golf club 10 is depicted in FIG. 1 and includes a shaft 20 and a head 30. Shaft 20 has a generally hollow, elongate configuration with a first end 21 and a second end 22. A grip 23 may extend over first end 21 to provide a comfortable and slip-resistant area for grasping golf club 10. Suitable materials for shaft 20 include conventional golf club shaft materials, such as graphite or steel, for example. Head 30 is secured to second end 22 and forms a generally planar face 31 that is configured to engage a golf ball, thereby propelling the golf ball in an intended direction. As depicted in the figures, head 30 has a generally hollow, enlarged configuration that provides golf club 10 with the structure of a driver.

During the game of golf, an individual takes hold of grip 23 (i.e., the individual grasps shaft 20 adjacent to first end 21) and swings golf club 10 such that head 30 traverses a generally curved or arcuate path and impacts the golf ball. A portion of the inertia of golf club 10, and particularly the inertia of head 30, is then transferred to the golf ball and propels the golf ball toward an intended target. Following impact with the golf ball, golf club 10 may have a tendency to vibrate. The degree of vibration exhibited by golf club 10 is moderated, however, by a damping element 40 that is positioned within shaft 20 and extends along at least a portion of shaft 40. Damping element 40 may have the configuration of a fluid-filled chamber, but may also be a polymer foam element, for example. As golf club 10, and particularly shaft 20, vibrates following impact with the golf ball, damping element 40 absorbs energy associated with the vibrations, thereby damping the vibrations.

Figure 2:
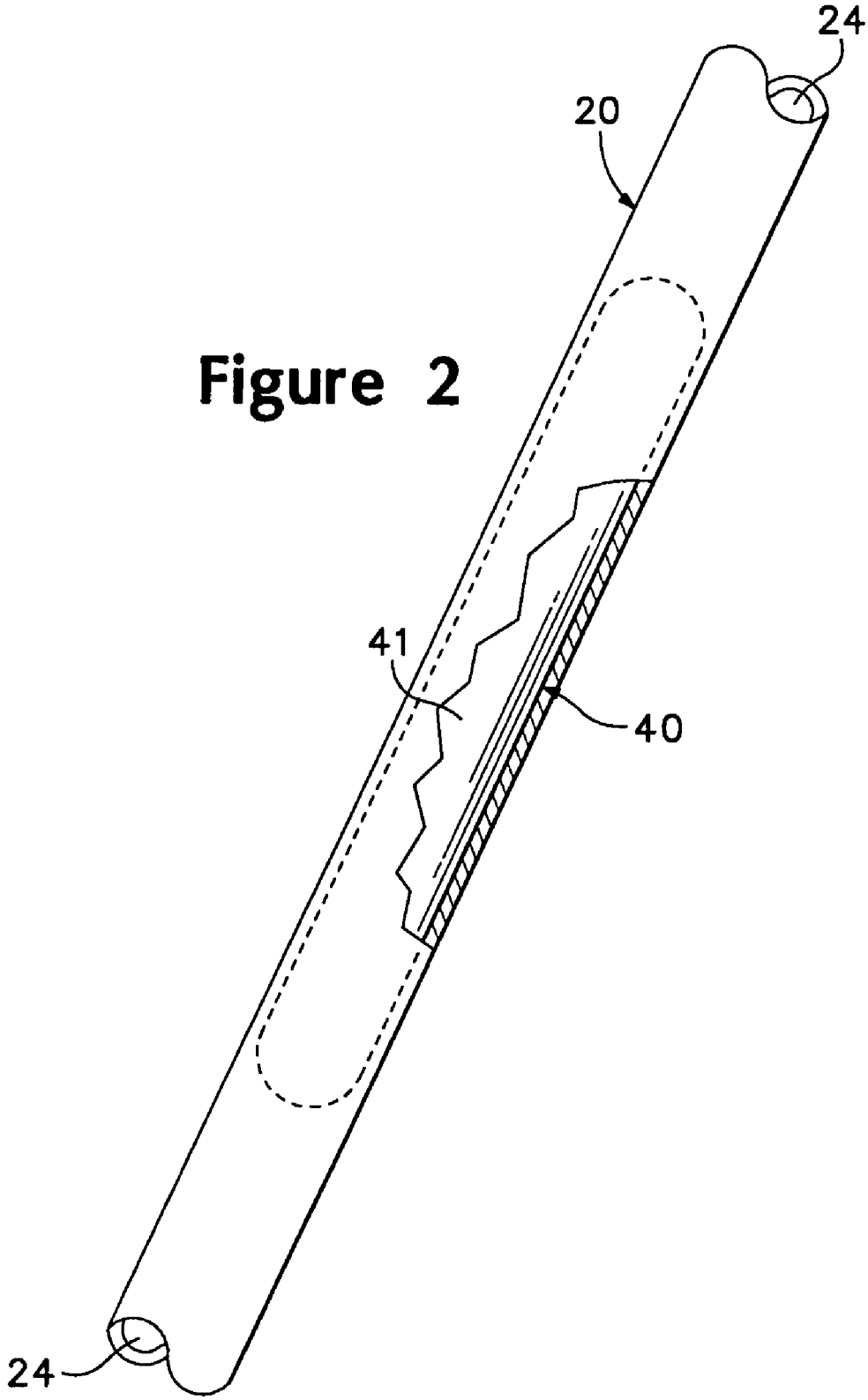
FIG. 2 is a cut-away elevational view of a portion of the shaft that exposes the damping element.
Figure 3:
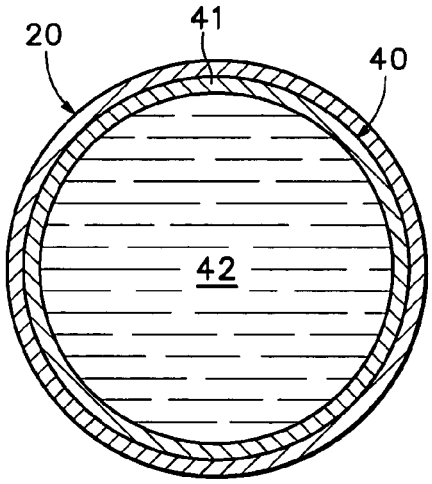
FIG. 3 is a cross-sectional view of the shaft, as defined by section line 3-3 in FIG. 1.
Figure 4:
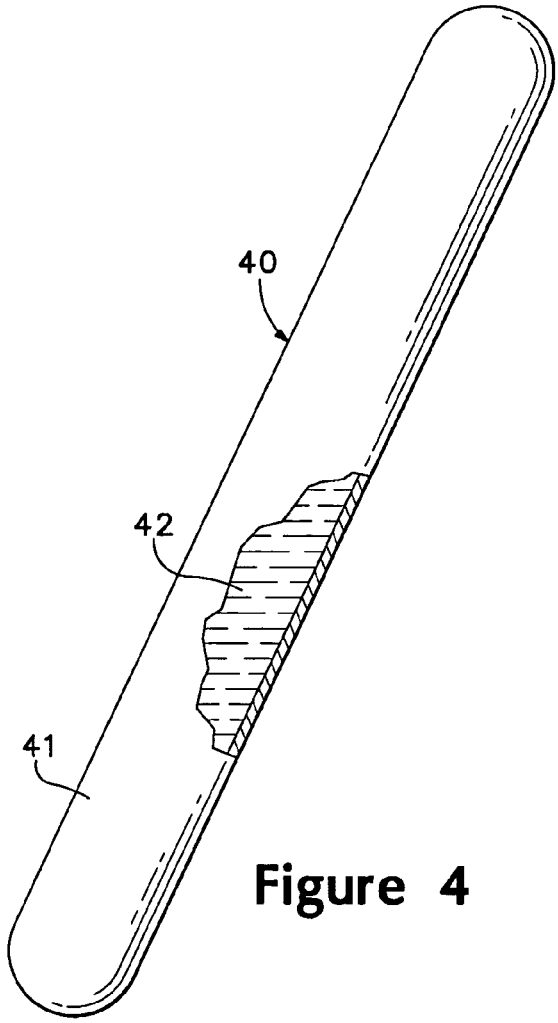
FIG. 4 is an elevational view of the damping element.

Damping element 40, as depicted in FIGS. 2-4, includes a sealed outer barrier 41 that encloses a fluid 42. Barrier 41 has a relatively narrow, elongate configuration that is proportioned to correspond with the hollow area within shaft 20. The material forming barrier 41 may be a polymer material, such as a thermoplastic elastomer, that is substantially impermeable to a liquid or gas selected for fluid 42. Damping element 40 may exhibit, therefore, the structure of a fluid-filled chamber disclosed in U.S. Pat. No. 4,183,156 to Rudy, hereby incorporated by reference.

The hollow configuration of shaft 20 forms a void 24 on the interior of shaft 20 for receiving damping element 40. A dimension extending across void 24 (i.e., the interior diameter of shaft 20) may range from one millimeter to over 20 millimeters. Accordingly, the width of damping element 40 may be selected to conform to the dimension extending across void 24. That is, damping element 20 may have a configuration that fits within void 24 and extends along at least a portion of void 24. In some embodiments, damping element 40 may be incorporated into shaft 20 such that barrier 41 places substantial outward force on shaft 20 due to the pressure of fluid 42. That is, damping element 40 may have a natural width that exceeds the dimension extending across void 24, and damping element 40 may be placed within shaft 20 so as to be in a compressed configuration. In other embodiments, damping element 40 may have a natural width that is approximately the dimension extending across void 24, or damping element 40 may have a natural width that is slightly less than the dimension extending across void 24. In order to limit movement of damping element 40 within void 24, an adhesive bond may be formed between damping element 40 and shaft 20, or shaft 20 may form various protrusions that extend into void 24 on either side of damping element 40, for example.

The position of damping element 40 in FIG. 1 is depicted as being approximately half the distance between first end 21 and second end 22. In further embodiments, however, damping element 40 may be positioned in other areas of shaft 20. Similarly, the length of damping element 40 is depicted as extending along only a relatively small portion of shaft 20. In general a ratio of the length of damping element 40 to the width of damping element 40 is at least 5:1, but may also range from 2:1 to 50:1. With reference to FIGS. 5A to 5I, damping element 40 is depicted as being positioned in a variety of locations along shaft 20, and various length to width ratios for damping element 40 are depicted.

Figure 5A:
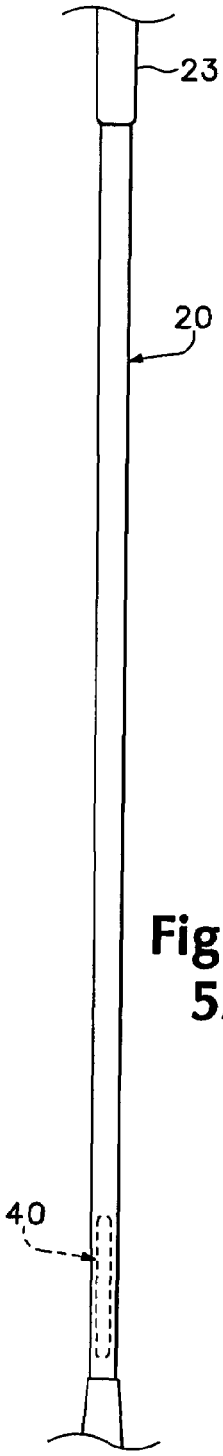
FIGS. 5A-5J are elevational views of a plurality of shaft configurations in accordance with the present invention.
Figure 5B:
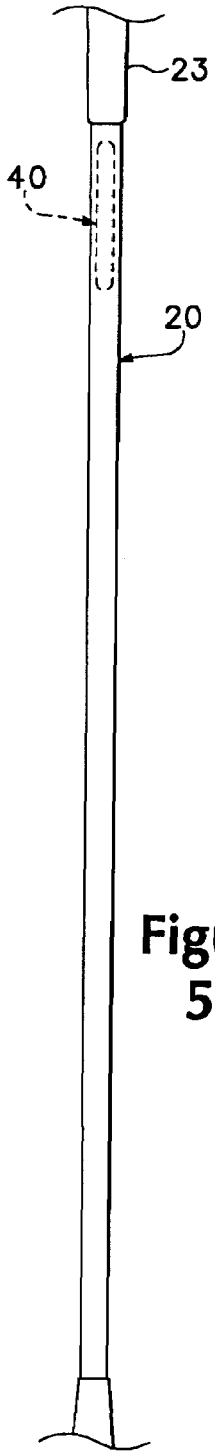
Figure 5C:
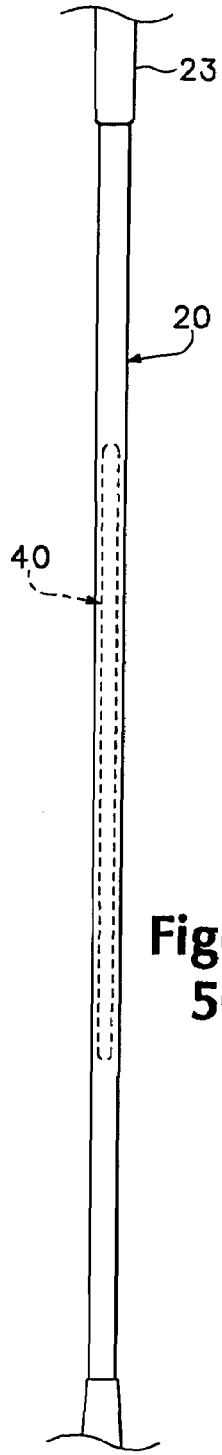
Figure 5D:
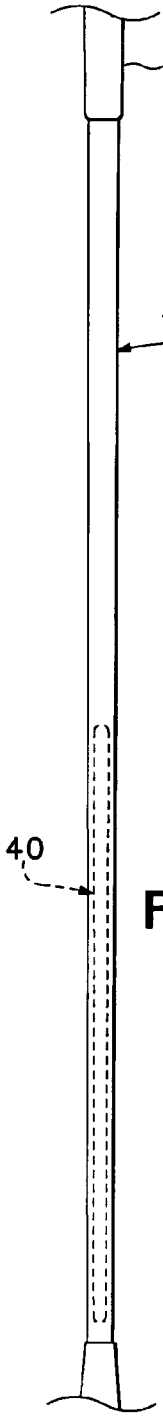
Figure 5E:
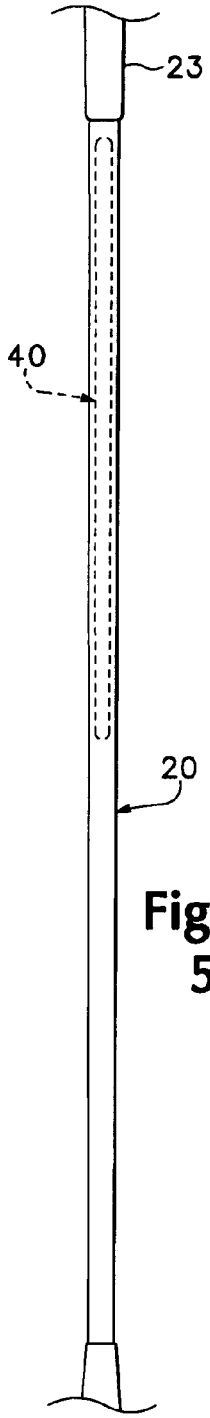
Figure 5F:
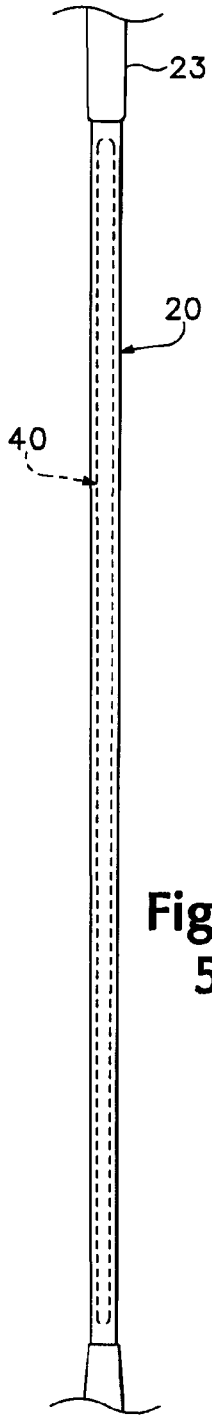
Figure 5G:
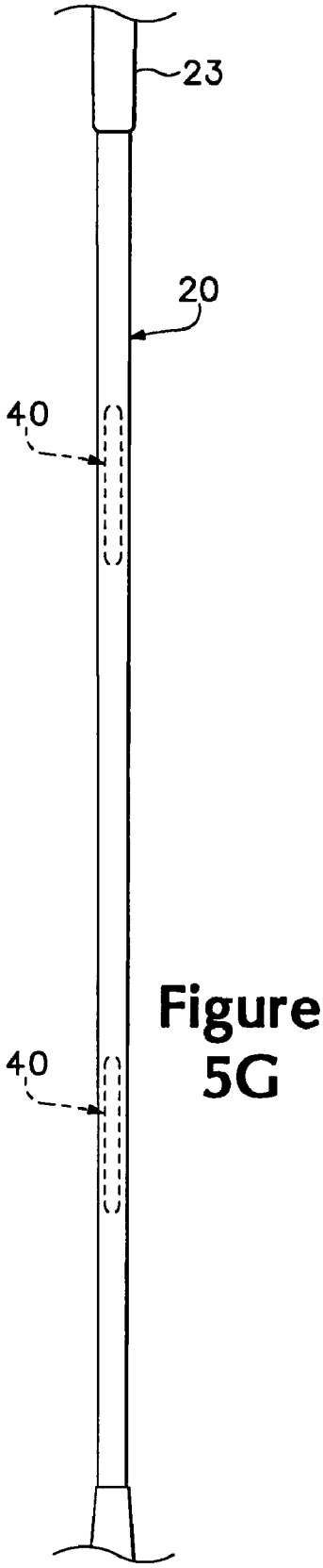
Figure 5H:
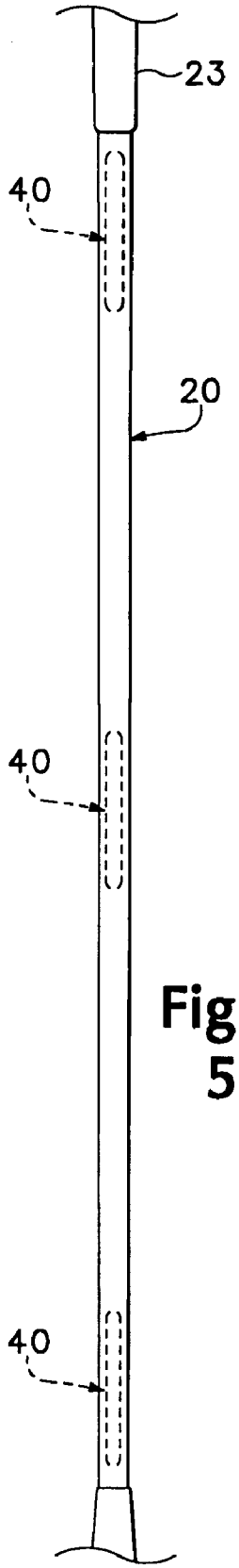
Figure 5I:
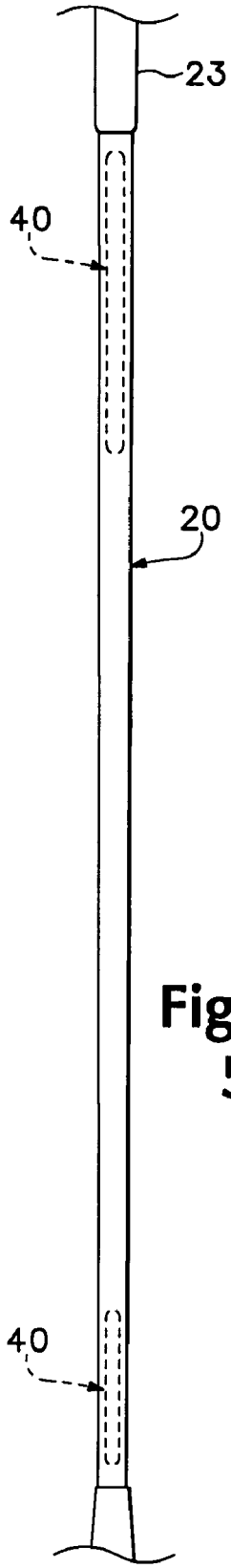
Figure 5J:
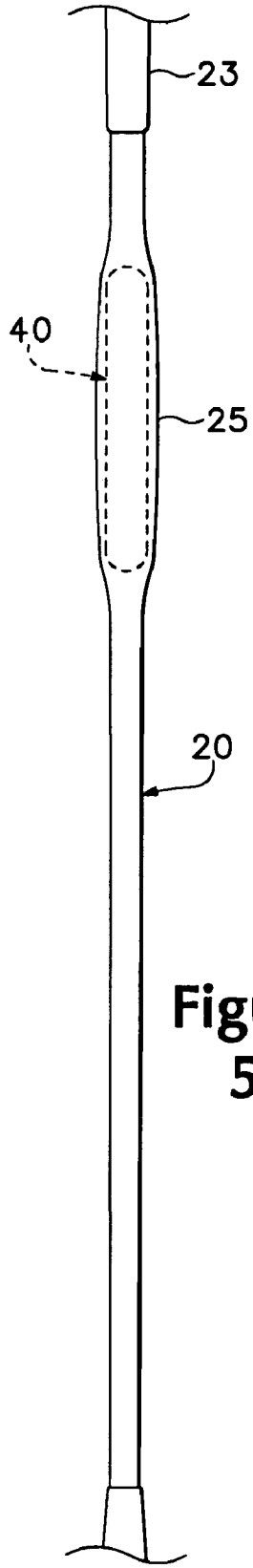

Whereas damping element 40 is centrally-located in FIG. 1, damping element 40 is positioned adjacent second end 22 in the configuration of FIG. 5A. Similarly, damping element 40 is positioned adjacent first end 21 in the configuration of FIG. 5B. With reference to FIG. 5C, damping element 40 has a length that is approximately one-half the length of shaft 20 and is centrally-located. In FIGS. 5D and 5E, damping element 40 also has a length of approximately one-half the length of shaft 20, but is respectively located adjacent second end 22 and first end 21. A further increase in the length of damping element 40 is depicted in the configuration of FIG. 5F, wherein damping element 40 extends along substantially the entire length of shaft 20. The above discussion illustrates embodiments wherein a single damping element 40 is positioned within shaft 20. Referring to FIGS. 5G and 5H, two and three damping elements 40 are respectfully depicted. Whereas the damping elements 40 in FIGS. 5G and 5H exhibit a similar length, damping elements 40 in FIG. 5I exhibit different lengths. With reference to FIG. 5J, damping element 40 is depicted as being positioned within shaft 20, which includes an outward protrusion 25 to receive damping element 40. Damping element 40 may be formed to have a diameter or size that is generally greater than the diameter of shaft 20, and protrusion 25 may be utilized to retain the position of damping element 40 with respect to the length of shaft 20. The above discussion illustrates, therefore, that various possible configurations and combinations for shaft 20 and damping element 40 are intended to fall within the scope of the present invention.

Figure 6A:
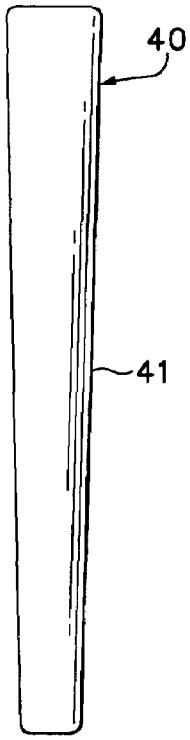
FIG. 6A-6F are plan views of a plurality of damping element configurations within the scope of the present invention.
Figure 6B:
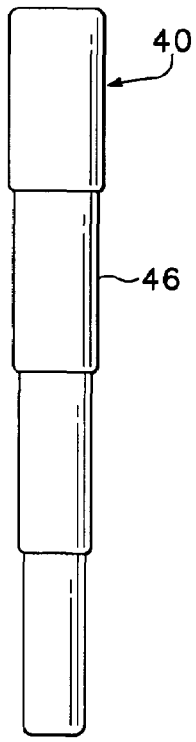
Figure 6C:
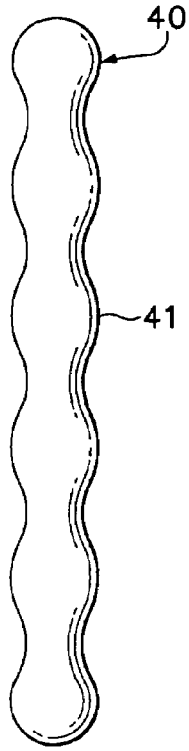
Figure 6D:
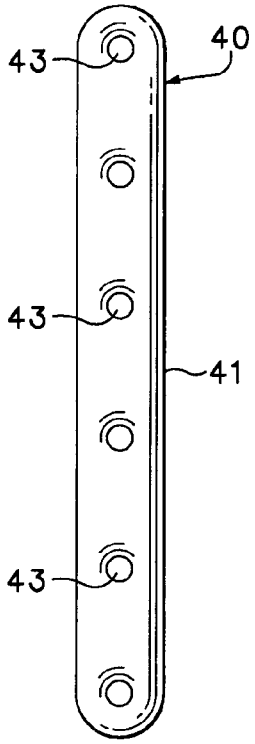
Figure 6E:
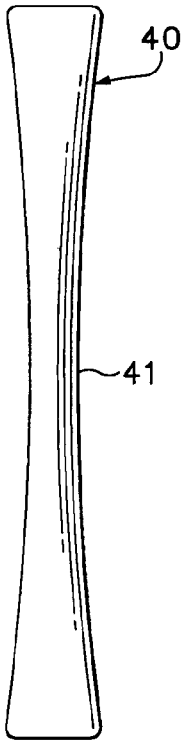
Figure 6F:
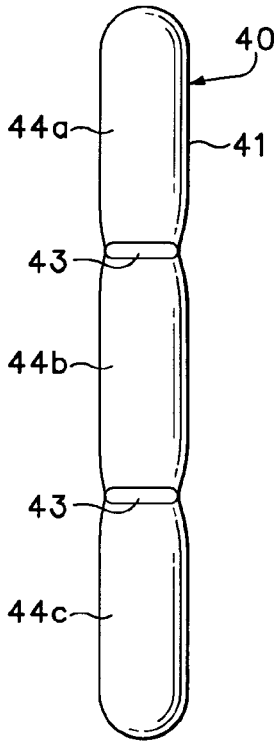

Although shaft 20 may have a cylindrical configuration with a constant thickness throughout the length, shaft 20 may also exhibit a tapered or stepped configuration, for example. That is, the diameter of shaft 20 may decrease from the area corresponding with first end 21 to the area corresponding with second end 22. In embodiments where shaft 20 exhibits a tapered or stepped configuration, void 24 may have a corresponding configuration. Accordingly, damping element 40 may also have a tapered or stepped configuration to correspond with the shape of void 24, as depicted in FIGS. 6A and 6B, respectively. Damping element 40 may also have a corrugated or undulating structure forming a plurality of protrusions that contact the interior surface of shaft 20, as depicted in FIG. 6C. The various configurations of damping element 40 discussed above have a generally round structure. A relatively flat structure may be imparted to damping element 40, however, by bonding opposite sides of barrier 41 together at selected bonding sites 43, as depicted in FIG. 6D. Damping element 40 may also have a configuration wherein end portions exhibit a greater width than central portions, as depicted in FIG. 6E. In the various embodiments discussed above, damping element 40 is a single chamber. Referring to FIG. 6F, however, damping element 40 is depicted as having three chambers 44*a* to 44*c* that are formed by bonding opposite sides of barrier 41 in a manner that segregates each of chambers 44*a* to 44*c* from each other. The pressure of fluid 42 in each of chambers 44*a* to 44*c* may be different. For example, chambers 44*a* and 44*c* may have a relatively low pressure, and chamber 44*b* may have a relatively high pressure. Alternately, chambers 44*a* and 44*c* may have a relatively high pressure, and chamber 44*b* may have a relatively low pressure, for example. Fluid 42 in each of chambers 44*a*-44*c* may also have different pressures, or different fluids 42 may be utilized. Accordingly, damping element 40 may have a variety of configurations within the scope of the present invention.

The material forming barrier 41, as discussed above, may be a polymer material, such as a thermoplastic elastomer, that is substantially impermeable to fluid 42. More specifically, a suitable material for barrier 41 is a film formed of alternating layers of thermoplastic polyurethane and ethylene-vinyl alcohol copolymer, as disclosed in U.S. Pat. Nos. 5,713,141 and 5,952,065 to Mitchell et al, hereby incorporated by reference. A variation upon this material wherein the center layer is formed of ethylene-vinyl alcohol copolymer; the two layers adjacent to the center layer are formed of thermoplastic polyurethane; and the outer layers are formed of a regrind material of thermoplastic polyurethane and ethylene-vinyl alcohol copolymer may also be utilized. Another suitable material is a flexible microlayer membrane that includes alternating layers of a gas barrier material and an elastomeric material, as disclosed in U.S. Pat. Nos. 6,082,025 and 6,127,026 to Bonk et al., both hereby incorporated by reference. Other suitable thermoplastic elastomer materials or films include polyurethane, polyester, polyester polyurethane, polyether polyurethane, such as cast or extruded ester-based polyurethane film. Additional suitable materials are disclosed in U.S. Pat. Nos. 4,183,156 and 4,219,945 to Rudy, hereby incorporated by reference. In addition, numerous thermoplastic urethanes may be utilized, such as PELLETHANE, a product of the Dow Chemical Company; ELASTOLLAN, a product of the BASF Corporation; and ESTANE, a product of the B.F. Goodrich Company, all of which are either ester or ether based. Still other thermoplastic urethanes based on polyesters, polyethers, polycaprolactone, and polycarbonate macrogels may be employed, and various nitrogen blocking materials may also be utilized. Further suitable materials include thermoplastic films containing a crystalline material, as disclosed in U.S. Pat. Nos. 4,936,029 and 5,042,176 to Rudy, hereby incorporated by reference, and polyurethane including a polyester polyol, as disclosed in U.S. Pat. Nos. 6,013,340; 6,203,868; and 6,321,465 to Bonk et al., also hereby incorporated by reference. Fluid 42 may include any of the gasses disclosed in U.S. Pat. No. 4,340,626 to Rudy, hereby incorporated by reference, such as hexafluoroethane and sulfur hexafluoride, for example. In addition, fluid 42 may include pressurized octafluorapropane, nitrogen, or air. The pressure of fluid 42 may range from a gauge pressure of zero to forty pounds per square inch, for example.

Damping element 40 may be manufactured through a variety of manufacturing techniques, including a two-film technique, thermoforming, blowmolding, and rotational molding, for example. The specific manufacturing method for damping element 40 may depend upon the material selected for barrier 41 and the desired configuration of damping element 40, for example.

With regard to the two-film technique, two separate layers of elastomeric barrier 41 are formed to have the overall shape of the damping element 40. The layers are then bonded together or at least partially sealed along their respective peripheries to form the internal area for enclosing fluid 42. Damping element 40 is subsequently pressurized above ambient pressure by inserting a nozzle or needle, which is connected to a fluid pressure source, into a fill inlet formed in barrier 41. Following pressurization, the nozzle is removed and the fill inlet is sealed, by welding for example. With respect to the configuration of FIG. 6D, for example, an additional step of bonding opposite sides of barrier 41 at predetermined interior locations may be performed. Similarly, chambers 44*a*-44*c* may be segregated by forming bonds that extend entirely across damping element 40. In a variation upon this technique, conventionally referred to as thermoforming, a fluid with positive pressure is applied between the layers of barrier 41 to induce the layers into the contours of a mold. In addition, a vacuum may be induced in the area between the layers of barrier 41 and the mold to draw the layers into the contours of the mold.

Another manufacturing technique for manufacturing a fluid-filled chamber like damping element 40 is through a blowmolding process, wherein a liquefied elastomeric material is placed in a mold having the desired overall shape and configuration of damping element 40. The mold has an opening at one location through which pressurized air is provided. The pressurized air induces the liquefied elastomeric material against the inner surfaces of the mold and causes the material to harden in the mold, thereby forming the damping element 40 to have the desired configuration. Rotational molding is similar to blowmolding in that a liquefied elastomeric material is placed in a mold having the desired overall shape and configuration of damping element 40. The mold is then rotated and centrifugal force induces the liquefied elastomeric material against the inner surfaces of the mold.

Following manufacture, damping element 40 is located within golf club 10. More particularly, damping element 40 is incorporated into shaft 20. Many graphite shafts, for example, are produced by wrapping carbon sheets (i.e., prepreg sheets) around a core rod, and then applying heat to harden the material. The number of sheets may be varied to attain a hardness, torque, or weight, for example, that is specified for the shaft. The specifications of the shaft may also be modified by incorporating boron or other materials to increase the strength of the shaft, or by adjusting the thickness or shape of the core rod. Following hardening of the shaft, the core rod is removed and a head is secured to the shaft. Damping element 40 may replace a portion of the core rod such that damping element 40 remains positioned within shaft 20 after the core rod is removed. Alternately, damping element 40 may be placed within shaft 20 following removal of the core rod. Accordingly, damping element 40 may be incorporated into shaft 20 during manufacture or following manufacture. Furthermore, damping element 40 may be utilized to retrofit an existing shaft in order to damp vibrations in the shaft.

As an alternative to the manufacturing method for shaft 20 discussed above, shaft 20 may be formed by compression or bladder molding, wherein a pressurized bladder having the desired shape of the void within shaft 20 is stretched over the mandrel. The material forming shaft 20 is wrapped around the bladder and compressed by a die. Once shaft 20 is formed, the fluid within the pressurized bladder is evacuated and the bladder is removed from the void within shaft 20. Although either of these manufacturing methods may be utilized for shaft 20, a variety of other manufacturing methods may also be utilized.

Figure 7D:
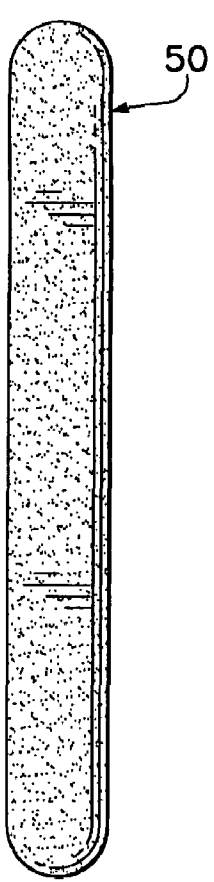
FIG. 7A-7H are plan views of a plurality of additional damping element configurations within the scope of the present invention.
Figure 7C:
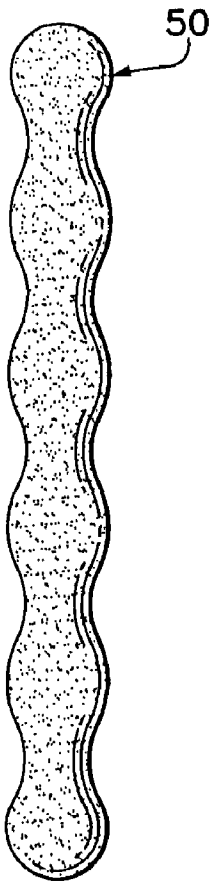
Figure 7B:
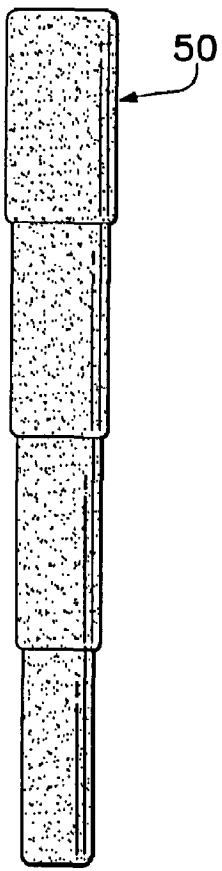
Figure 7A:
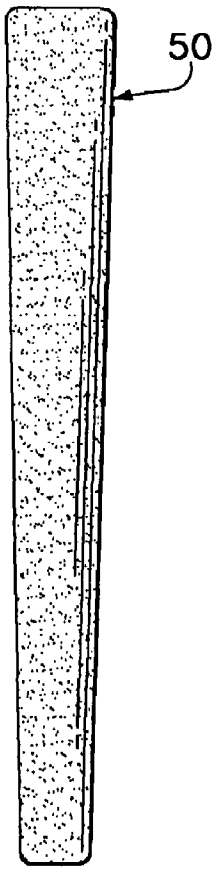
Figure 7H:
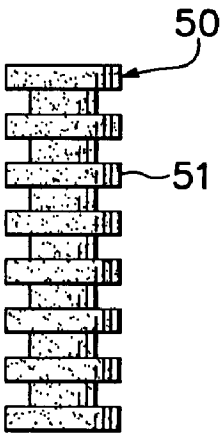
Figure 7G:
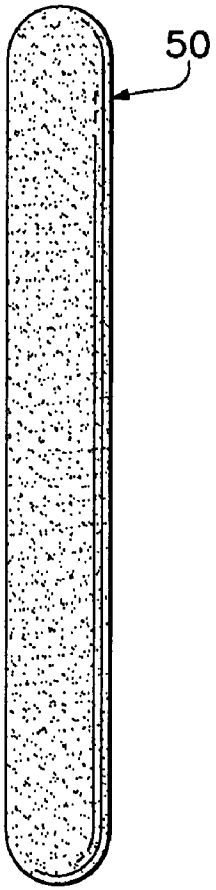
Figure 7F:
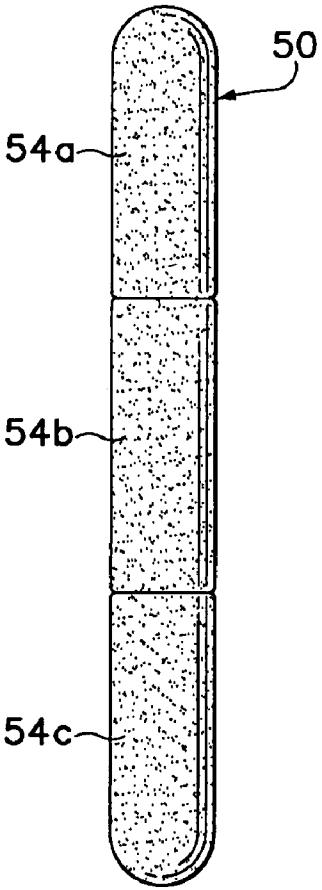
Figure 7E:
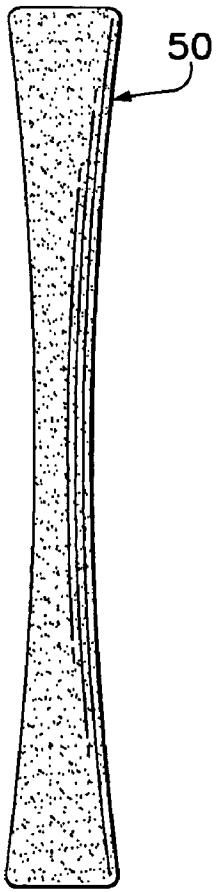

Damping element 40 is described above as having the configuration of a fluid-filled chamber. Damping element 40 may be replaced, however, with a damping element 50 that is formed from a polymer foam material, such as polyurethane or ethylvinylacetate. In addition, a microcellular foam having a specific gravity of 0.5 to 0.7 g/cm$^3$ and a hardness of 70 to 76 on the Asker C scale may be utilized. In contrast with damping element 40, damping element 50 may have a solid configuration without an interior volume for enclosing a fluid. The general shape of damping element 50 may, however, resemble the general shape of damping element 40. For example, damping element 50 may have a tapered or stepped configuration, as depicted in FIGS. 7A and 7B, respectively. Damping element 50 may also have corrugated or undulating structure that forms a plurality of protrusions that contact the interior surface of shaft 20, as depicted in FIG. 7C. A relatively flat structure may be imparted to damping element 50, as depicted in FIG. 7D. Damping element 50 may also have a configuration wherein end portions exhibit a greater width than central portions, as depicted in FIG. 7E. In the various embodiments discussed above, damping element 50 is formed of a single foam. Referring to FIG. 7F, however, damping element 50 is depicted as having three areas 54*a* to 54*c* that are formed of polymer foam materials with different densities. For example, areas 54*a* and 54*c* may have a relatively low density, and area 54*b* may have a relatively high density. Alternately, areas 54*a* and 54*c* may have a relatively high density, and area 54*b* may have a relatively low density, for example. Each of areas 54*a*-54*c* may also have different densities. Damping element 50 may also have a generally cylindrical configuration, as depicted in FIG. 7G, or damping element may have a generally configuration that includes a plurality of circular fins, as depicted in FIG. 7H. Accordingly, damping element 50 may have a variety of configurations within the scope of the present invention.

As golf club 10, and particularly shaft 20, vibrates following impact with the golf ball (or the ground), damping element 40 (or damping element 50) absorbs energy associated with the vibrations, thereby damping the vibrations. If no damping forces were associated with shaft 20, then shaft 20 would continue to vibrate at a constant amplitude following impact with the golf ball. For any harmonic motion, however, various forces tend to reduce the amplitude of each successive vibration (i.e., the forces damp the motion). If these forces are small compared to the restoring force arising from the original displacement, then the object will vibrate a relatively large number of times with successively smaller amplitudes until the motion gradually ends. For example, frictional forces associated with the air surrounding the golf club will tend to steadily reduce the amplitude of vibration. In addition, grasping the shaft will also absorb a portion of the vibrational forces. Although absorbing a portion of the vibrational forces does not generally pose concerns, repeatedly absorbing a portion of the vibrational forces may affect the hands or the joints of the individual. Accordingly, damping element 40 may be utilized to absorb the vibrational forces and limit the amount of vibrational forces that are absorbed by the individual.

Figure 8:
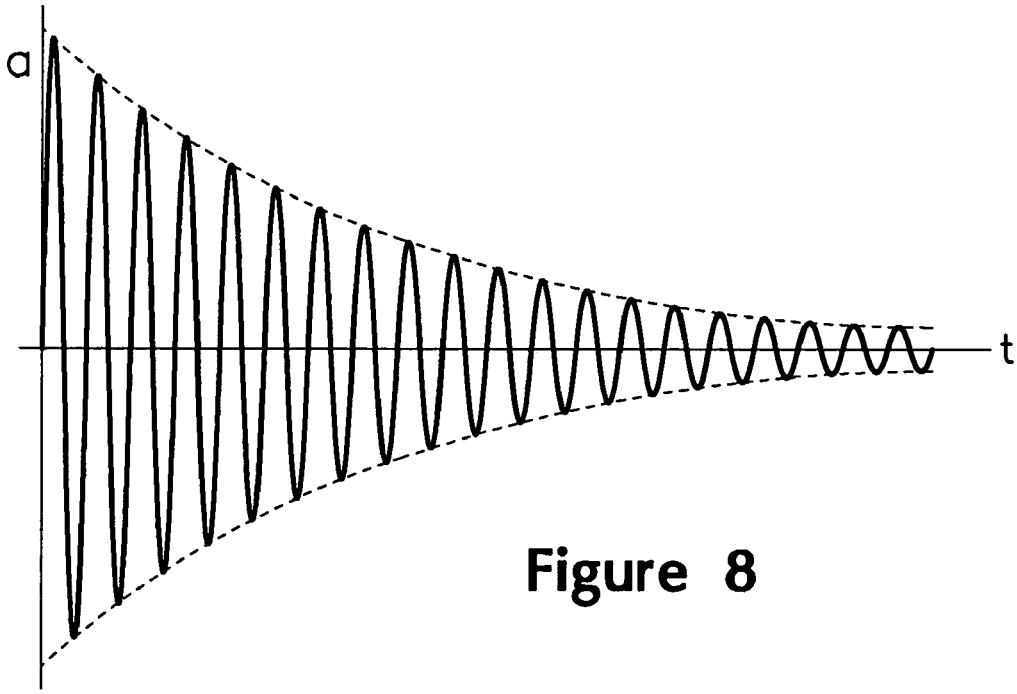
FIG. 8 is a first graphical representation of vibration characteristics of the golf club depicted in FIG. 1.
Figure 9:
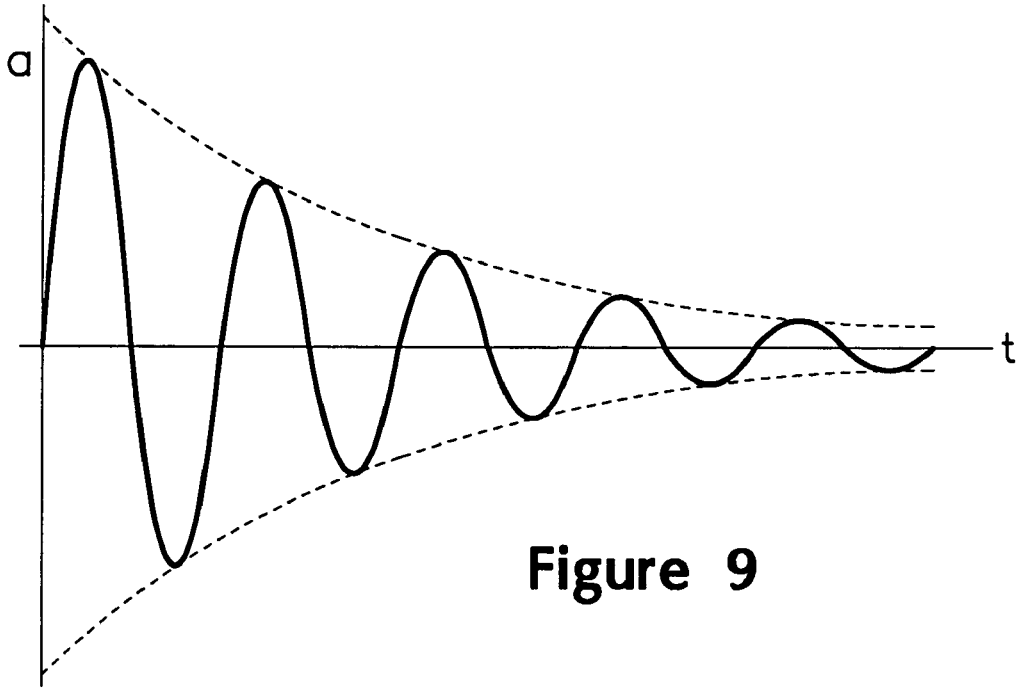
FIG. 9 is a second graphical representation of vibration characteristics of the golf club depicted in FIG. 1.
Figure 10:
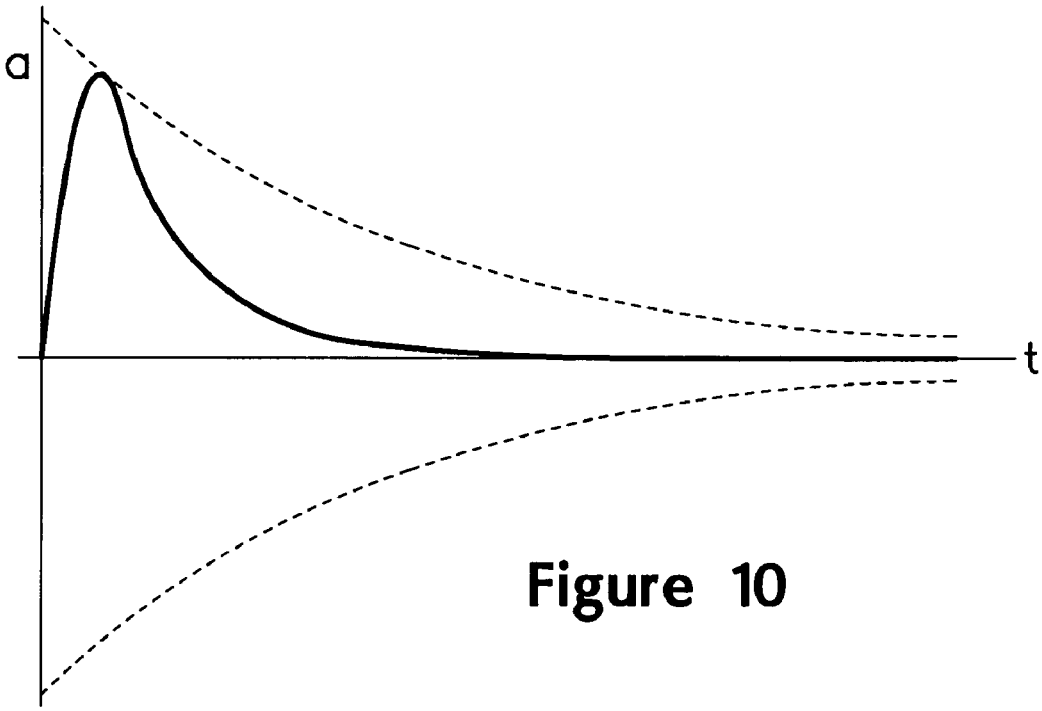
FIG. 10 is a third graphical representation of vibration characteristics of the golf club depicted in FIG. 1.

Three graphical representations of damping scenarios are depicted in FIGS. 8-10. In each of the graphical representations, a horizontal axis represents time (t) and a vertical axis represents an amplitude of vibration (a). In addition, each graphical representation includes a generally sinusoidal line that represents the vibration in shaft 20. Referring to FIG. 8, the line decreases substantially in amplitude over the course of approximately twenty periods of vibration. A similar decrease in amplitude occurs in FIG. 9 over the course of five periods of vibration. In accordance with each of FIGS. 8 and 9, therefore, damping element 40 operates to reduce the amplitude of vibration over a relatively small number of periods of vibration, a scenario that is conventionally referred to as damped harmonic motion. In FIG. 10, however, complete damping occurs during the first period of vibration, a scenario that is conventionally referred to as overdamped harmonic motion.

The configurations of shaft 20 and head 30 have an effect upon the overall damping in golf club 10. The configuration of damping element 40 (or damping element 50), however, is primarily responsible for providing a damping effect. That is, the features of damping element 40 will determine whether shaft 20 vibrates in the manner depicted in FIG. 8, FIG. 9, or FIG. 10, for example. The above discussion provides numerous variations upon the structure of damping element 40. For example, the position with respect to shaft 20, the length, the quantity, the shape, and the pressure of damping element 40 all have an effect upon the damping characteristics of damping element 40. Similarly, the materials and shape of damping element 50 have an effect upon the damping characteristics of damping element 50. Accordingly, damping elements 40 or 50 with different configurations may be utilized to modify or tune the vibrational characteristics of shaft 20.

Damping element 40 (or damping element 50) may also be utilized to modify other characteristics of golf club 10. Although damping element 40 has a relatively small mass, damping element 40 does increase the overall mass of golf club 10. Depending upon the position of damping element 40 with respect to shaft 20, the effective inertia of golf club 10 during a golf swing may be affected. For example, if damping element 40 is positioned adjacent second end 22 (i.e., adjacent head 30), then a greater inertial force may be transferred to the golf ball through head 30. If, however, damping element 40 is positioned adjacent first end 21, then a lesser inertial force may be transferred to the golf ball through head 30. The bending or stiffness characteristics of shaft 20 may also be affected by the presence and location of damping element 40. For example, damping element 40 may be positioned in a relatively flexible portion of shaft 20 to increase the stiffness in that particular area of shaft 20. The stiffness may also be affected by the thickness of barrier 41 and the pressure of fluid 42. Accordingly, these factors may be modified to adjust the stiffness of shaft 20. Similar considerations may be utilized with respect to damping element 50, wherein the position and foam density of damping element 50 may be utilized to adjust both inertial force and stiffness of shaft 20.

Figure 11:
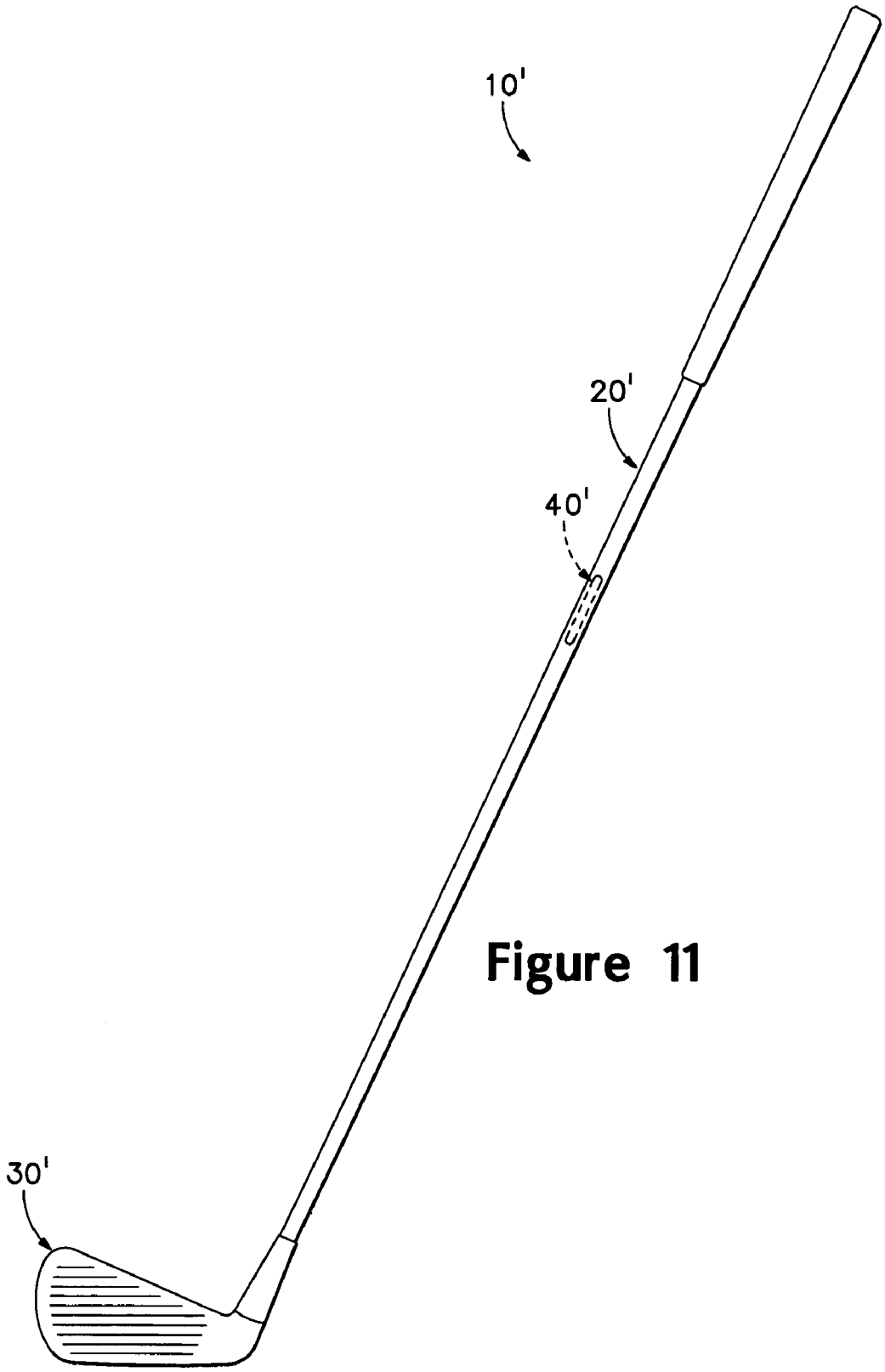
FIG. 11 is an elevational view of another golf club having a shaft with a damping element in accordance with the present invention.

The above discussion focuses upon golf club 10, which is depicted as having the configuration of a driver. Concepts related to the present invention apply, however, to a variety of golf club styles. Referring to FIG. 11, a golf club 10' having the configuration of an iron is depicted. Golf club 10' includes a shaft 20' and a head 30' that may have a conventional configuration for an iron. In addition, golf club 10' includes a damping element 40' that is positioned within shaft 20'. Damping element 40' may have the general configuration of damping element 40 or damping element 50. Accordingly, the vibrational characteristics of golf club 10' may be selectively varied through the configuration of damping element 40'.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A golf club comprising:

a head defining a face for contacting a golf ball;

an elongate shaft having an exterior surface and an opposite interior surface, the interior surface defining a void within the shaft, the void having an outwardly-projecting area that forms a protrusion in the shaft, the shaft also having a first end and an opposite second end, the shaft including an area for gripping the golf club that is positioned proximal the first end, and the shaft including an area for securing the head to the shaft that is positioned proximal the second end, the protrusion being positioned between the area for gripping the golf club and the area for securing the head to the shaft; and a fluid-filled and pressurized chamber having a sealed and valveless configuration, substantially all of the chamber being located within the protrusion and positioned between the area for gripping the golf club and the area for securing the head to the shaft.

2. The golf club recited in claim 1, wherein the fluid is a gas.

3. The golf club recited in claim 1, wherein the chamber is formed of a polymer material that is substantially impermeable to the fluid.

4. The golf club recited in claim 3, wherein the polymer material is a thermoplastic elastomer,

5. The golf club recited in claim 1, wherein a shape of the chamber corresponds with a shape of the void within the shaft.

6. The golf club recited in claim 1, wherein the chamber has an elongate configuration.

* * * * *